US009849465B2

(12) United States Patent
Bernardis

(10) Patent No.: US 9,849,465 B2
(45) Date of Patent: Dec. 26, 2017

(54) MINERAL ORE FLOTATION USING CARBOXYMETHYL CELLULOSE WITH DIFFERENT CHARACTERISTICS IN DIFFERENT FLOTATION CELLS

(71) Applicant: CP KELCO OY, Aeaenekoski (FI)

(72) Inventor: Francesco Bernardis, Aeaenekoski (FI)

(73) Assignee: CP KELCO OY, Aeaenekoski (FI)

( * ) Notice: Subject to any disclaimer, the term of this patent is extended or adjusted under 35 U.S.C. 154(b) by 706 days.

(21) Appl. No.: 14/378,571

(22) PCT Filed: Jan. 29, 2013

(86) PCT No.: PCT/EP2013/051655

§ 371 (c)(1),
(2) Date: Aug. 13, 2014

(87) PCT Pub. No.: WO2013/120689

PCT Pub. Date: Aug. 22, 2013

(65) Prior Publication Data

US 2015/0021236 A1 Jan. 22, 2015

(30) Foreign Application Priority Data

Feb. 16, 2012 (FI) ..... 20125179

(51) Int. Cl.
*B03D 1/02* (2006.01)
*B03D 1/06* (2006.01)
(Continued)

(52) U.S. Cl.
CPC ..... *B03D 1/008* (2013.01); *B03D 1/016* (2013.01); *B03D 1/02* (2013.01); *B03D 1/06* (2013.01);
(Continued)

(58) Field of Classification Search
CPC ..... B03D 1/008; B03D 1/016; B03D 1/02; B03D 1/06; B03D 2201/06; B03D 2203/02
See application file for complete search history.

(56) References Cited

U.S. PATENT DOCUMENTS 5,011,596 A * 4/1991 Shaw ..... B03D 1/008 209/167
2008/0067112 A1* 3/2008 Kuhn ..... C22B 1/00 209/167

FOREIGN PATENT DOCUMENTS

RU 2209687 C2 8/2003
RU 2403981 C1 11/2010

OTHER PUBLICATIONS

McFadzean, B. et al. "The Effect of Molecular Weight on the Adsorption and Efficacy of Polysaccharide Depressants," International Mineral Processing Congress, vol. 6, 2010, pp. 2177-2185.
(Continued)

*Primary Examiner* — Thomas M Lithgow
(74) *Attorney, Agent, or Firm* — Eversheds Sutherland (US) LLP

(57) ABSTRACT

A flotation method for mineral processing is disclosed. The method for floating includes a first step of using a first carboxymethyl cellulose (CMC) in a first flotation cell, and a subsequent step includes using a second CMC in a subsequent flotation cell, the first and second CMCs having different characteristics. The first flotation cell may be used in at least one rougher stage and/or at least one rougher-scavenger stage of the flotation method, and the subsequent flotation cell may be used in at least one cleaner stage, and/or at least one cleaner scavenger stage, and/or at least one recleaner stage of the flotation method. A product may be obtained, directly or indirectly, by such a method. A mineral
(Continued)

processing plant may use at least two CMCs of different characteristics in flotation for mineral processing.

12 Claims, 5 Drawing Sheets

(51) Int. Cl.
*B03D 1/008* (2006.01)
*B03D 1/016* (2006.01)

(52) U.S. Cl.
CPC ..... *B03D 2201/06* (2013.01); *B03D 2203/02* (2013.01)

(56) References Cited

OTHER PUBLICATIONS

PCT International Search Report and Written Opinion for PCT/EP2013/051655, dated May 15, 2013.
Russian Office Action for RU Application No. 2014128553 dated Dec. 27, 2016 (English Translation) (8 pages).

* cited by examiner

MINERAL ORE FLOTATION USING CARBOXYMETHYL CELLULOSE WITH DIFFERENT CHARACTERISTICS IN DIFFERENT FLOTATION CELLS

TECHNICAL FIELD

The present disclosure relates to a method for floating. More particularly, the present disclosure relates to a method for floating minerals by use of carboxymethyl cellulose (CMC). The present disclosure relates also to a product obtained by the method and to the use of at least two CMCs of different characteristics in flotation for mineral processing.

BACKGROUND

Carboxymethyl cellulose (CMC) is used in mineral processing as a flotation depressant. One and the same CMC is used as a flotation depressant in the different flotation processes in a mineral processing plant. A mineral processing plant uses one and the same CMC for any one of their flotation processes and the characteristics of the CMC used is always the same and depends on the ore and desired characteristics of the plants final concentrate. Thus, the CMC used at one plant has only one characteristic.

CMC is mainly for the depression of carbonate and talcaceous gangue in the flotation of Cu—Ni sulfide ores. In recent years applications have also been found in the beneficiation of platinum group metal (PGM) ores. CMC has been tested for the separation of coal from pyrite and it is reported as a selective depressant in the flotation of salt-type minerals, as a slime depressant in potash flotation and as a selective depressant in differential sulfide flotation.

Depression of talc and readily floatable magnesia-bearing minerals in nickel flotation has been carried out for years, particularly in Canada, Australia and Southern Africa. Polysaccharides in the form of natural gums, and starches and dextrin-type compounds have been the most commonly used depressants. The use of carboxymethyl cellulose reagents have been known in copper-nickel flotation since the early 1950's when research was conducted in the USSR.

Although CMC is a depressant which can be used in the flotation of ores, understanding the interaction mechanisms between CMC and mineral particles in different flotation circuits and different pulp conditions is still limited. A better understanding of these mechanisms is desired in order to optimize the flotation process and make it more cost-effective. More knowledge about the importance of structural features of CMC in flotation processes is also desired.

Even the smallest improvement in the flotation process has a large impact on the total costs of mineral processing, because the flotation process gives a certain initial percentage of the desired minerals and this percentage is what the remaining downstream processes have to work with. A higher concentration of the desired mineral in the concentrate of the flotation process is desired (for a given recovery of that mineral). To be able to influence the concentrate is important for mineral processing. It is desirable to influence the flotation performance, for example increasing or decreasing the mineral content of the concentrate. A decrease in the amount of CMC is desired.

The present disclosure is directed to overcoming one or more of the problems as set forth above.

SUMMARY

It is an object of the present invention to provide an improved flotation process. This object can be achieved by the features of defined in the independent claims. Further enhancements are characterized by the independent claims.

According to one embodiment, the present disclosure is directed to a method for floating, wherein a first step comprises using a first carboxymethyl cellulose (CMC) in a first flotation cell, and a subsequent step comprises using a second CMC in a subsequent flotation cell, the first and second CMCs having different characteristics.

According to one embodiment, the present disclosure is directed to a product obtained, directly or indirectly, by the method. Preferably, the product is a concentrate (of minerals).

According to one embodiment, the present disclosure is directed to the use of at least two CMCs of different characteristics in flotation for mineral processing.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any other claimed embodiment(s).

BRIEF DESCRIPTION OF THE DRAWINGS

The accompanying drawings illustrate presently preferred exemplary embodiments of the disclosure, and together with the general description given above and the detailed description of the preferred exemplary embodiments given below, serve to explain, by way of example, the principles of the disclosure.

DETAILED DESCRIPTION

Sodium Carboxy Methyl Cellulose (CMC) is a polyelectrolyte derived from cellulose. Cellulose is a straight chain polymer consisting of anhydroglucose units linked together by β-1,4-bonds and it has a regular hydrogen-bonded structure, which is not readily water-soluble. Each anhydroglucose monomer has three available hydroxyl groups. The addition of a certain chemical group on the cellulose backbone transforms the polymer into a water-soluble product.

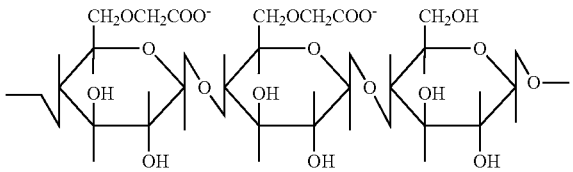

Sodium Carboxymethyl Cellulose

CMC is prepared by the reaction of the cellulose hydroxyls with sodium monochloroacetate. The main reaction is the following:

RcellOH+NaOH+ClCH2COONa->ROCH2COONa+ NaCl+H2O

The control of reaction conditions determines the properties of the resultant reaction products. The following physical and chemical parameters are used to characterize CMC:

Degree of Substitution (DS)

This is the average number of carboxymethyl groups introduced to one anhydroglucose unit. For commercial qualities of CMC, DS varies between 0.4 and 1.5, theoretically DS varies between 0 and 3.

CMC Content

This is the degree of purity of the product, and is measured as the percentage of sodium CMC present.

Degree of Polymerization (DP)

This expresses the average number of glucose units per cellulose ether molecule, and it is a function of chain length, and therefore molecular weight.

Structure

The structure of CMC molecule varies with degree of substitution and degree of polymerisation. However, for reagents with the same DS and DP it is possible to introduce further variations by positioning substituted radicals along the chain. Radicals may be evenly or unevenly distributed along the chain.

In at least one embodiment, the characteristics (properties) of CMC can be altered by changing the DS, the CMC content, the DP, and/or the structure of CMC molecules. Hereby a certain CMC may be given characteristics that improve the flotation process.

According to at least one embodiment, the flotation process of a mineral processing plant may be supplied with a first CMC and a subsequent CMC that is different from the first CMC. The characteristics of the first and subsequent CMC differ. The CMC used for a certain step of the flotation process may be tailored so to influence the flotation process of that step. While previously the ore dictated the characteristics of the CMC, the characteristics of the CMC can be tailored to not only the ore but also to the different steps in the flotation process.

Figure 1:
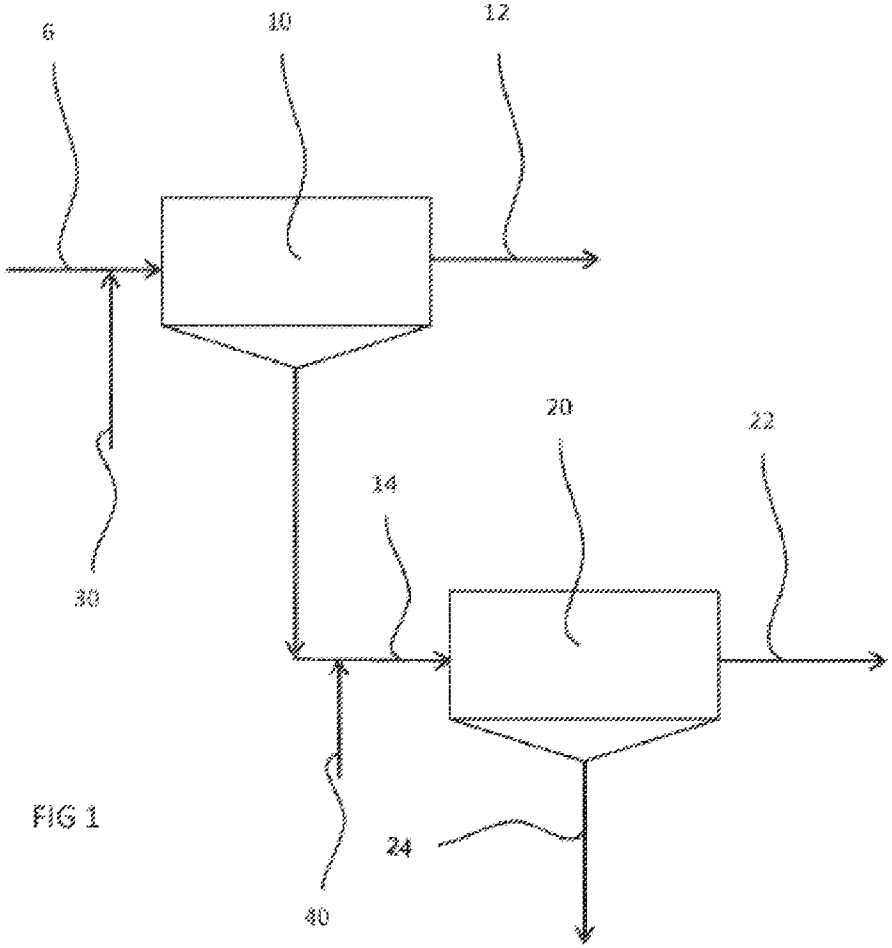
FIG. 1 shows a flow chart of a flotation method according to an exemplary embodiment of the present disclosure.

FIG. 1 shows a flow chart of a flotation method according to an exemplary embodiment of the present disclosure. The flow chart illustrates a part of a flotation process of a mineral processing plant. The flotation method comprises a first flotation cell 10 and a subsequent flotation cell 20. The first flotation cell 10 is a rougher flotation cell compared with the subsequent flotation cell 20, which is a cleaner flotation cell. A first feed 6 is fed to the first flotation cell 10. The output of the first flotation cell 10 is a tail 12 (waste) and a subsequent feed 14 (concentrate/froth). The subsequent feed 14 is fed, directly or indirectly, to the subsequent flotation cell 20. The output of the subsequent flotation cell 20 is a subsequent tail 22 (recycled/waste) and a concentrate 24 (froth). The first flotation cell 10 is, directly or indirectly, arranged before the subsequent flotation cell 20 in a flow direction of the mineral feed.

A first CMC 30 is added to the first feed 6 of the first flotation cell 10. A second CMC 40 is added to the subsequent feed 14. The characteristic of the first CMC 30 differs from the characteristic of the second CMC 40. Hereby the flotation process of the first flotation cell 10 and the flotation process of the subsequent flotation cell 20 may be optimized. The optimization of a flotation cell can take place independently from other flotation cells. The flotation cells may be parallel and/or in series with each other.

Figure 2:
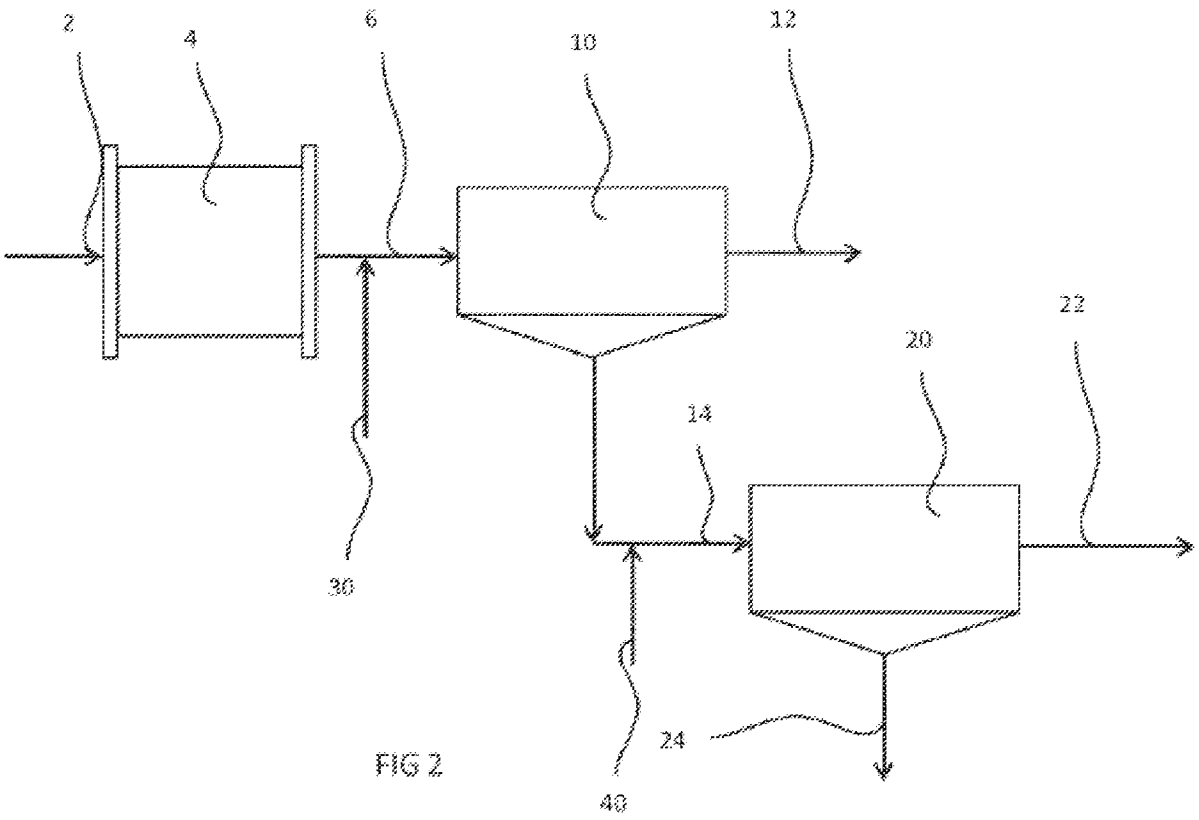
FIG. 2 shows a flow chart of an exemplary flotation method according to an exemplary embodiment of the present disclosure.
Figure 3:
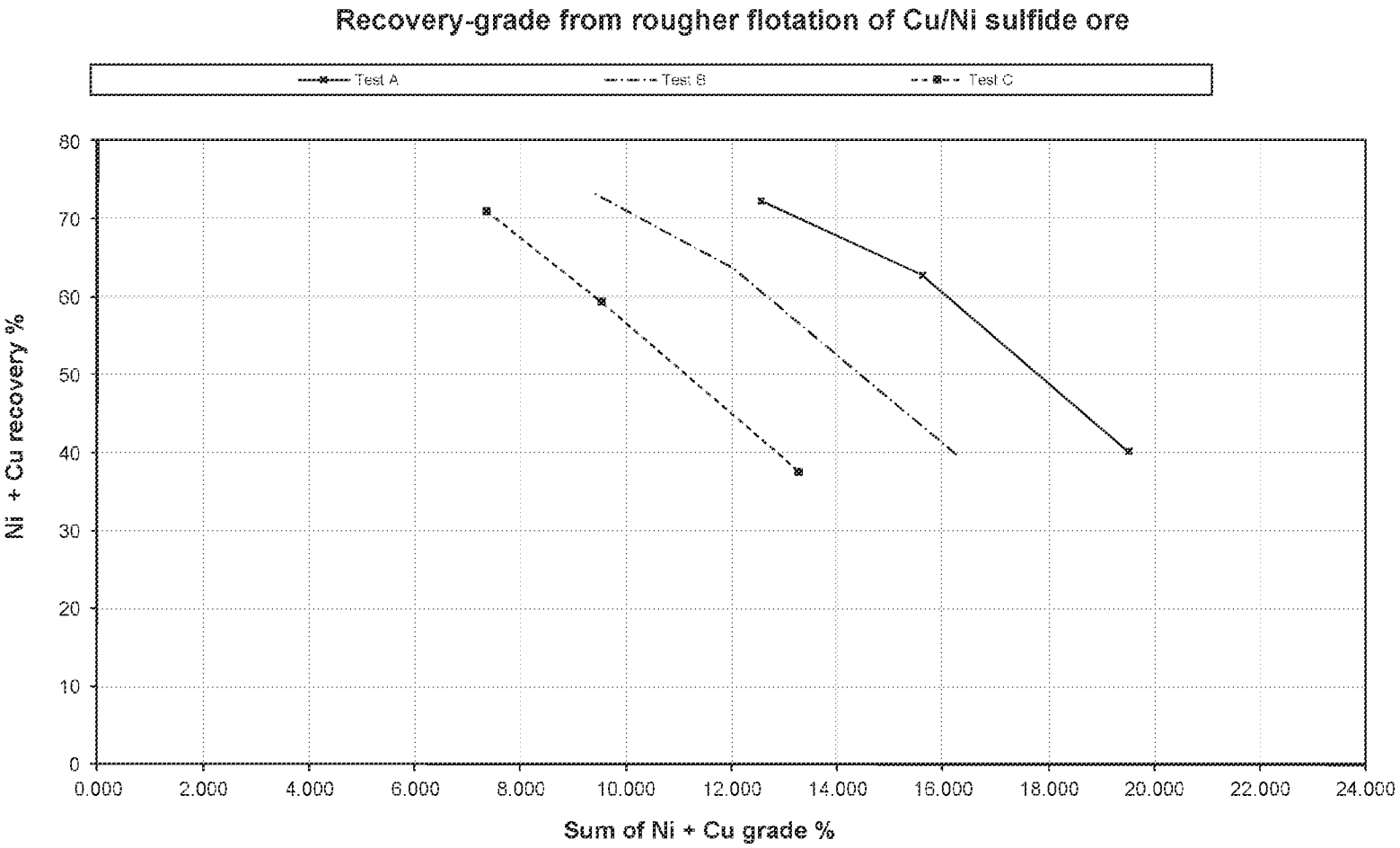
FIG. 3 shows a chart illustrating an embodiment of recovery-grade from exemplary rougher flotation of a Cu/Ni sulphide ore, where the x-axis illustrates the sum of Ni+Cu grades in percentage, while the y-axis illustrates the Ni+Cu recovery in percentage.

FIG. 2 shows a flow chart of a flotation method according to an exemplary embodiment of the present disclosure. The flow chart illustrates a part of a flotation process of a mineral processing plant. The flotation method comprises a first flotation cell 10 and a subsequent flotation cell 20. The first flotation cell 10 is a rougher flotation cell compared with the subsequent flotation cell 20, which is a cleaner flotation cell.

Crushed ore 2 is fed into a mill 4. The mill 4 outputs a first feed 6 that is fed to the first flotation cell 10. The output of the first flotation cell 10 is a tail 12 (waste) and a subsequent feed 14 (concentrate/froth). The concentrate 14 is fed, directly or indirectly, to the subsequent flotation cell 20. The output of the subsequent flotation cell 20 is a tail 22 (recycled/waste) and a concentrate 24 (froth). The first flotation cell 10 is, directly or indirectly, arranged before the subsequent flotation cell 20 in a flow direction of the mineral feed.

A first CMC 30 is added to the first feed 6 of the first flotation cell 10. A second CMC 40 is added to the subsequent feed 14. The characteristic of the first CMC 30 differs from the characteristic of the second CMC 40. Hereby the flotation process of the first flotation cell 10 and the flotation process of the subsequent flotation cell 20 may be optimized. The optimization of a flotation cell can take place independently from other flotation cells. The flotation cells may be parallel and/or in series with each other.

While FIGS. 1 and 2 illustrates only a first flotation cell 10 and a subsequent flotation cell 20, the flotation method may have more than only these two flotation cells. The flotation cells may be parallel and/or in series with each other. The different CMCs 30, 40 used with different characteristics may be more than only two, for example three or four. A flotation cell within a mineral processing plant may have its performance optimized by tailoring a CMC especially for that flotation cell. This can be done for more than one or two flotation cells, or groups of flotation cells.

According to one embodiment, a flotation method comprises a first step comprising using a first CMC 30 in a first flotation cell 10, and a subsequent step comprising using a second CMC 40 in a subsequent flotation cell 20, the first and second CMCs 30 and 40 having different characteristics.

According to one embodiment, the first CMC 30 may have a degree of substitution (DS) that is different from a DS of the second CMC 40. Preferably, the DS of the first CMC 30 is lower than the DS of the second CMC 40. The difference in DS may be at least 0.4. A difference in DS may possibly be at least 0.3 or 0.35. Preferably, the DS of the first CMC 30 is in the range of 0.4-0.9 and the DS of the second CMC 40 is in the range of 0.8-1.5. The DS range of the first CMC 30 may be 0.4-0.6, 0.4-0.55, or 0.42-0.55. The DS range of the second CMC 40 may be 0.8-1.4, 0.9-1.3, or 1.0-1.2. In one embodiment, the DS of the first CMC 30 is about 0.44 or 0.53 and the DS of the second CMC 40 is about 1.1.

According to one embodiment, the characteristics of the CMC 30, 40 may be altered by not only the DS, but also by other properties and characteristics, alone or in combination. In one embodiment, the first CMC 30 has a viscosity that is different from a viscosity of the second CMC 40. In one embodiment, the first CMC 30 has a molecular weight that is different from a molecular weight of the second CMC 40. These embodiments may, as stated before and applicable to all embodiments in this disclosure, be combined which each other.

According to one embodiment, the first flotation cell 10 is preferably at least one rougher stage and/or at least one rougher-scavenger stage of the flotation method. The subsequent flotation cell 20 is preferably at least one cleaner stage, and/or at least one cleaner scavenger stage, and/or at least one recleaner stage of the flotation method. Thus the first flotation cell 10 handles a rougher stage of the mineral feed than the subsequent flotation cell 20. The first CMC 30 may have a DS that is lower than the DS of the second CMC 40.

In at least one embodiment, a separate application of a lower DS CMC 30 to at least one rougher stage 10 and/or at least one rougher-scavenger stage 10 of a flotation process may be used, while a separate application of a higher DS CMC 40 to at least one cleaner stage 20, at least one cleaner scavenger stage 20, and/or at least one recleaner stage 20 of a flotation process may be used.

According to one embodiment, the first step comprises producing a first concentrate that is fed, directly or indirectly, to the subsequent step. The two steps may be in series or in parallel.

According to one embodiment, a product may be obtained, directly or indirectly, by any one of the previous embodiments. This product may be a concentrate, preferably a concentrate of minerals. The product may be a base metal sulphide concentrate or a base metal Cu—Ni sulphide concentrate.

According to one embodiment, at least two CMCs 30, 40 of different characteristics are used in flotation for mineral processing. Mineral flotation made during mineral processing may use different CMCs 30, 40 having different characteristics and thereby optimize the flotation in each flotation cell 10, 20. The embodiments described herein also describe the use of the method for flotation for mineral processing.

According to one embodiment, the first flotation cell 10 and/or subsequent flotation cell 20 is/are a group of flotation cells. A CMC of a specific characteristic may be used for such a group of flotation cells.

According to one embodiment, a mineral plant may be supplied with at least two CMCs of different characteristics. Such supply may be tailored to the specific ore and/or mineral flotation method used.

By using at least two CMCs of different characteristics, different CMC depressants, the mineral processing may be influenced in a desired way. The function, the process itself, and the costs may each by themselves, or combined with one or more, effect the mineral process. The combined amount of the two CMCs used may be less compared with the amount of CMC used with only one and the same characteristic.

The characteristics of the CMC as described in one or more embodiments herein influence the function of the CMC. The CMC can act as a depressant or as a dispersant/activator. The depressant may effect one or more of the grade of a concentrate or feed, and the penalty elements, such as for example MgO. The dispersant/activator effects one or more of the thickening, the filtration, the recovery, the grade, and other reagent dosage (e.g. collector). For example, the reagent costs may be decreased. For example, the recovery of the mineral or metal in questions may be increased or decreased. For example, the grade may influence the transport volume and costs, since the concentrate must be transported to a smelter. For example, the grade may effect the metal loss in the smelter and the reprocessing options. For example, the grade and/or penalty elements may have an impact on the smelter, e.g. capex, downtime, addition of iron to the smelter, etc. For example, the penalty elements may have an impact on the acid consumption during hydrometallurgical processing. Such impacts, effects, and changes to a plant for mineral processing have an important effect on one or more of the running of the plant, its costs, and the outcome, such as the concentrate. The flotation process can be tuned by using at least two different CMCs at different flotation cells.

One or more embodiments may result in a desired enhanced performance and benefits of the plant. A higher grade at given recovery, or recovery of grade ratios, for valuable minerals and/or higher Fe:MgO ratios at given Ni recoveries. For example, High Fe:MgO ratios and/or high Ni grades with high Fe:MgO ratios. Fe:MgO ratios are especially valuable to (Ni) smelters which operate flash smelting technology. At least one embodiment described herein may improve the selectivity requirements of the depressant for the flotation process. For example, at a rougher flotation stage a high degree of valuable mineral activation may be achieved, and/or a modest depressant selectivity for gangue minerals. For example, at a cleaner flotation stage maintained and/or enhanced valuable mineral activation may be achieved, and/or a higher degree of depressant selectivity for gangue minerals.

At least one embodiment achieves efficient and effective depression, at a rougher stage. At least one embodiment achieves effective activation/dispersion and/or selective depression at a cleaner stage.

At least one embodiment may be applied to ores comprising, but not limited to, Fe, Cu and Ni sulphide minerals in addition to non-sulphide gangue minerals, including but not limited to Mg-bearing silicate gangue minerals. Enhanced performance benefits may for example be improved recovery-grade relationship for valuable minerals and/or higher Fe:MgO ratios at equivalent Ni recoveries. Fe:MgO ratios are especially valuable to smelters which operate flash smelting technology.

Enhanced flotation performance is obtained by at least one embodiment disclosed herein. Depression, dispersion, and activation may be functions of CMC modifiers in improved flotation. At least one embodiment may enhance the selectivity of the flotation processes and increase the Fe:MgO ratio of concentrates.

The following discloses some examples of using at least one of the embodiments during flotation in mineral processing. Flotation tests were carried out on a natural ore sample comprising, chalcopyrite, Ni sulphides, phyrrhotite and pyrite, as major sulphide mineralogy and feldspars, amphibole/pyroxene, quartz and muscovite as major silicate mineralogy. Ni and Cu contents of the ore were 0.45% each. Grinding of 1 kg of sub 2 mm crushed samples was carried out in a std laboratory mild steel rod mill at 66% pulp density in the presence of a collector for a predetermined period to a obtain a target grind size typically required for this ore type. The milled ore was then transferred to a flotation cell for conditioning of the ore with Xanthate collector, CMC depressant and frother. For rougher flotation three concentrates were collected over a total period of 4.5 minutes. For rougher-scavenger-cleaner flotation experiments a bulk rougher-scavenger concentrate was collected over 12.5 minutes, which was cleaned by flotation in a smaller cell in the presence of additional frother, collector and CMC depressant. A total of three cleaner concentrates were collected over a total cleaner flotation period of 8 minutes. The results of the three rougher flotation tests (A, B, and C) are presented in table 1, which also provides the relative DS levels of the CMC used as well as the dosage. All other reagents and conditions were maintained at the same level in each test. The results of four rougher-scavenger-cleaner flotation tests (Tests 1-4) are shown in Table 2, which provides the relative average DS level of the CMC in the various stages as well as the dosage of the CMC in the different stages. All other reagent dosages and conditions were maintained at the same level in each test.

TABLE 1

Rougher flotation data

| Test | DS of CMC | Rougher dosage of CMC (g/T) | Concentrate | Cum. Cu recovery (%) | Cum. Cu grade (%) | Cum. Ni recovery (%) | Cum. Ni grade (%) |
|---|---|---|---|---|---|---|---|
| A | 0.44 | 150 | Rgh Con 1 | 51.605 | 12.605 | 28.771 | 6.896 |
| | | | Rgh Con 2 | 76.194 | 9.517 | 49.479 | 6.082 |
| | | | Rgh Con 3 | 82.967 | 7.239 | 61.711 | 5.299 |
| B | 0.74 | 152 | Rgh Con 1 | 54.403 | 11.040 | 25.358 | 5.210 |
| | | | Rgh Con 2 | 78.486 | 7.380 | 48.759 | 4.642 |
| | | | Rgh Con 3 | 84.44 | 5.384 | 62.097 | 4.009 |
| C | 1.1 | 152 | Rgh Con 1 | 56.293 | 9.850 | 18.946 | 3.402 |
| | | | Rgh Con 2 | 79.390 | 6.306 | 39.520 | 3.221 |
| | | | Rgh Con 3 | 85.758 | 4.387 | 56.376 | 2.959 |

TABLE 2

Rougher-Scavenger-Cleaner data, first part

| Test no. | DS of CMC in rougher-scavenger/clean stage | Rougher-scavenger dosage of CMC (g/T) | Cleaner dosage of CMC (g/T) |
|---|---|---|---|
| 1 | 0.44/0.44 | 220 | 36 |
| 2 | 0.44/0.44 | 206 | 45 |
| 3 | 0.44/1.1 | 310 | 75 |
| 4 | 0.74/0.74 | 222 | 70 |

TABLE 2

Rougher-Scavenger-Cleaner data, second part

| Test no. | Concentrate | Cum. Cu recovery % | Cum. Cu grade % | Cum. Ni recovery % | Cum. Ni grade % | Cum. Fe:MgO |
|---|---|---|---|---|---|---|
| 1 | Combined rgh-scav | 87.707 | 4.222 | 75.770 | 3.624 | 1.408 |
| | Cln con 1 | 69.482 | 12.965 | 44.753 | 8.297 | 14.159 |
| | Cln con 2 | 77.211 | 10.705 | 57.748 | 7.955 | 9.805 |
| | Cln con 3 | 79.533 | 9.818 | 61.687 | 7.566 | 7.826 |
| 2 | Combined rgh-scav | 87.869 | 4.295 | 76.191 | 3.811 | 1.426 |
| | Cln con 1 | 63.359 | 15.900 | 30.997 | 7.960 | 16.759 |
| | Cln con 2 | 72.981 | 12.834 | 47.232 | 8.499 | 11.627 |
| | Cln con 3 | 76.128 | 11.602 | 53.466 | 8.338 | 9.312 |
| 3 | Combined rgh-scav | 88.025 | 4.307 | 76.850 | 3.744 | 1.418 |
| | Cln con 1 | 69.456 | 14.005 | 42.154 | 8.464 | 14.730 |
| | Cln con 2 | 76.366 | 12.081 | 54.117 | 8.525 | 11.036 |

TABLE 2-continued

Rougher-Scavenger-Cleaner data, second part

| Test no. | Concentrate | Cum. Cu recovery % | Cum. Cu grade % | Cum. Ni recovery % | Cum. Ni grade % | Cum. Fe:MgO |
|---|---|---|---|---|---|---|
| | Cln con 3 | 78.601 | 11.265 | 58.233 | 8.311 | 9.027 |
| 4 | Combined rgh-scav | 87.943 | 3.925 | 76.011 | 3.481 | 1.116 |
| | Cln con 1 | 65.434 | 15.730 | 31.534 | 7.779 | 13.834 |
| | Cln con 2 | 74.117 | 13.066 | 45.748 | 8.276 | 10.002 |
| | Cln con 3 | 76.826 | 11.984 | 50.877 | 8.144 | 7.834 |

Figure 4:
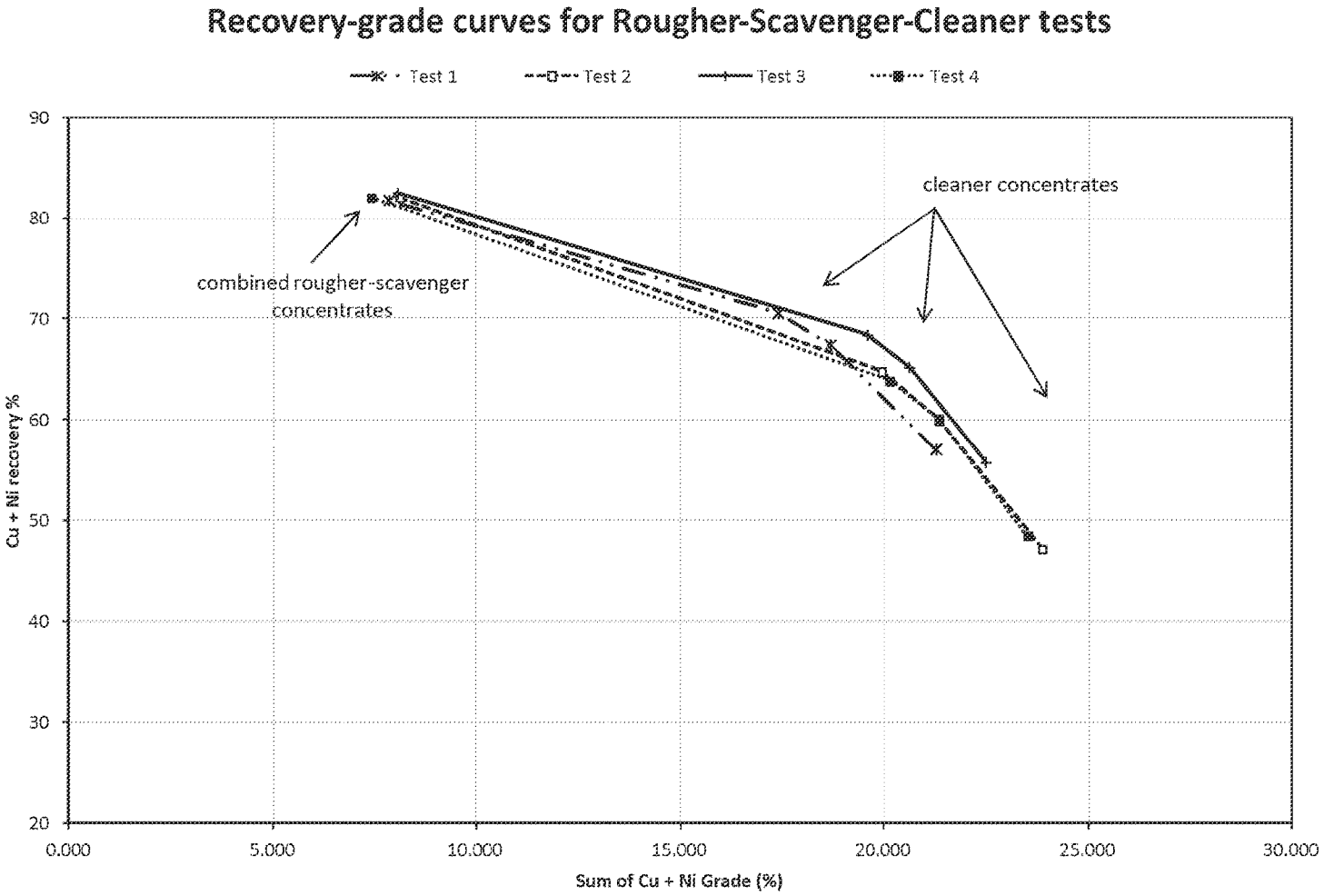
FIG. 4 shows a chart illustrating an embodiment of recovery-grade curves for exemplary rougher-scavenger-cleaner tests, where the x-axis illustrates the sum of Ni+Cu grades in percentage, while the y-axis illustrates the Ni+Cu recovery in percentage.

Tests A, B and C show that application of lower DS CMCs in the rougher stage afford the highest Cu and Ni grades per weight of CMC dosed, see FIG. 4, which suggests more effective/efficient depression from the lower DS CMCs.

Figure 5:
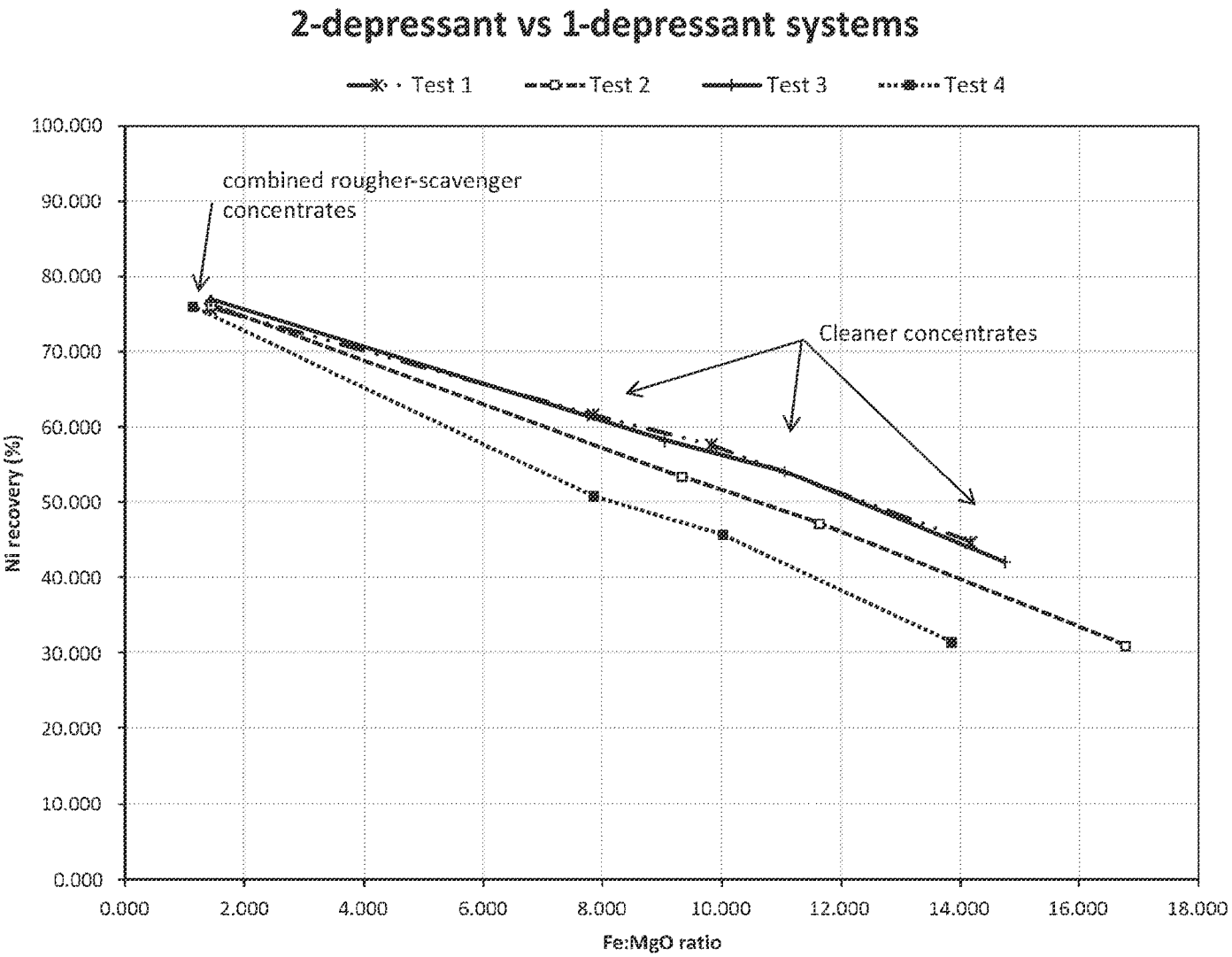
FIG. 5 shows a chart illustrating an embodiment of the 2-depressant system against the 1-depressant system, where the x-axis illustrates the Fe:MgO ratio, while the y-axis illustrates the Ni recovery in percentage.

Tests 1 and 2 show examples of the application of a low DS CMC to both the rougher-scavenger and cleaner stages of flotation and the recovery grade curves from these experiments, see FIG. 5, show that when higher CMC dosage is used in the cleaner stage that the Ni+Cu recovery in the cleaner stage decreases over the time period of flotation and that the corresponding Ni+Cu grade increases. This is considered common behaviour were depression, due to the CMC depressant, is a dominant mechanism. When considering the relationship between the Ni recovery and the Fe:MgO ratio for tests 1 and 2, see FIG. 4, it is apparent that the relationship is worse at the higher dosage (Test 2). This is also considered normal behaviour where increased depression of Fe-bearing sulphides and Ni-bearing sulphides outweigh the effect on MgO depression. Thus, test 1 and test 2 serve to demonstrate the optimum performance of the one depressant system for a low DS CMC, where test 1 affords the best Ni recovery vs Fe:MgO in the cleaner stage, while test 2 affords a slightly better recovery-grade curve in the cleaner stage.

Test 3 shows the effect of adding the low DS CMC to the rougher-scavenger stage, while adding the high DS CMC to the cleaner stage. The effect on the recovery-grade curve is to improve it in the cleaner stage, where it is superior to both test 1 or test 2. When comparing the Ni recovery vs Fe:MgO ratio of test 3, it is on a similar level to test 1. Thus, the difference between using the 2-depressant system against the 1 depressant system, is to improve the recovery-grade curve while maintaining a relatively high Fe:MgO ratio at equivalent Ni recovery.

Test 4 is an example of application of a medium DS CMC to both the rougher-scavenger and cleaner stages. The recovery-grade performance for this test was similar to that for test 2, see FIG. 5, and the effect on the Ni recovery vs Fe:MgO ratio, see FIG. 6, significantly worse than all the other tests, due to over depression of the Ni and Fe-bearing sulphides.

The method, product, and use discussed above improve the flotation process for mineral processing. The invention, therefore, is well adapted to carry out the objects and attain the ends and advantages mentioned, as well as others inherent therein. While the invention has been described and is defined by reference to particular preferred embodiments of the invention, such references do not imply a limitation on the invention, and no such limitation is to be inferred. The invention is capable of considerable modification, alteration, and equivalents in form and function, as will occur to those ordinarily skilled in the pertinent arts. The described preferred embodiments of the invention are exemplary only, and are not exhaustive of the scope of the invention. Consequently, the invention is intended to be limited only by the spirit and scope of the appended claims, giving full cognizance to equivalents in all respects.

LIST OF ELEMENTS

2 crushed ore
4 mill
6 first feed (to first flotation cell)
10 first flotation cell
12 tail (waste)
14 subsequent feed (concentrate/froth)
20 subsequent flotation cell
22 subsequent tail (recycled/waste)
24 concentrate (froth)
30 first CMC
40 second CMC

The invention claimed is:

1. A method for floating, the method comprising:

a first step comprising using a first carboxymethyl cellulose (CMC) in a first flotation cell to produce a first concentrate from a feed, and feeding, directly or indirectly, the first concentrate to a subsequent step comprising using a second CMC in a subsequent flotation cell to produce a product, wherein the first and second CMCs have one or more different characteristics.

2. The method of claim 1, wherein the first CMC has a degree of substitution (DS) that is different from a DS of the second CMC.

3. The method of claim 2, wherein the DS of the first CMC is lower than the DS of the second CMC.

4. The method of claim 1, wherein the first flotation cell is comprised in at least one rougher stage and/or at least one rougher-scavenger stage of the flotation method, and the subsequent flotation cell is comprised in at least one cleaner stage, and/or at least one cleaner scavenger stage, and/or at least one recleaner stage of the flotation method.

5. The method of claim 2, wherein the difference in DS is at least 0.4.

6. The method of claim 2, wherein the DS of the first CMC is in the range of 0.4-0.9 and the DS of the second CMC is in the range of 0.8-1.5.

7. The method of claim 2, wherein the DS of the first CMC is about 0.44 or 0.53 and the DS of the second CMC is about 1.1.

8. The method of claim 1, wherein the first CMC has a viscosity that is different from a viscosity of the second CMC.

9. The method of claim 1, wherein the first CMC has a molecular weight that is different from a molecular weight of the second CMC.

10. The method of claim 1, wherein the product is a concentrate of minerals.

11. The method of claim 1, wherein the product is a base metal sulphide concentrate.

12. The method of claim 1, wherein the product is a base metal Cu—Ni sulphide concentrate.

* * * * *